US005700422A

United States Patent [19]

Usui et al.

[11] Patent Number: 5,700,422

[45] Date of Patent: Dec. 23, 1997

[54] MOLTEN METAL SUPPLY DEVICE

[75] Inventors: Hirotake Usui; Kazuya Matsuura; Shin Nitta, all of Tokyo, Japan

[73] Assignee: Ryobi Ltd., Hiroshima-ken, Japan

[21] Appl. No.: 630,747

[22] Filed: Apr. 10, 1996

[30] Foreign Application Priority Data

Apr. 14, 1995 [JP] Japan ..... P7-113866
Apr. 14, 1995 [JP] Japan ..... P7-113867

[51] Int. Cl.[6] ..... C21D 11/00

[52] U.S. Cl. ..... 266/94; 266/239; 222/591

[58] Field of Search ..... 222/590, 591, 222/593, 594, 596; 266/236, 239, 94; 164/337, 312

[56] References Cited

U.S. PATENT DOCUMENTS

| | | | |
|---|---|---|---|
| 4,428,413 | 1/1984 | Lester | 222/596 |
| 4,635,706 | 1/1987 | Behrens | 222/593 |
| 4,793,596 | 12/1988 | Kubota et al. | 266/239 |
| 5,315,686 | 5/1994 | Caugherty et al. | 222/593 |
| 5,454,423 | 10/1995 | Tsuchida et al. | 164/337 |

*Primary Examiner*—Scott Kastler
*Attorney, Agent, or Firm*—Sughrue, Mion, Zinn, Macpeak & Seas, PLLC

[57] ABSTRACT

A molten metal supply device capable of supplying molten metal with high precision to an injection sleeve of a die-casting machine, and capable of reducing molten metal leakage and damage to a molten metal conduit bridging between a holding furnace and the injection sleeve. The holding furnace is divided into a holding chamber and a supply chamber in fluid connection with the injection sleeve through the conduit. Both chambers can be selectively brought into and out of fluid connection by a stopper. First and second immersion bodies are immersibly provided to the chambers, respectively. The laser sensor detects a predetermined level of the molten metal. The first immersion body is immersed until the sensor detects the surface of the molten metal, whereupon the stopper blocks fluid communication between the chambers. By then lowering the second immersion body, molten metal is pushed out of the supply chamber and a predetermined amount of molten metal is supplied to the injection sleeve. The conduit includes a duct and a mouthpiece, The duct is provided by an inner ceramic layer, an outer stainless steel tube, a heat line wound over the stainless steel tube, and a mortar layer.

14 Claims, 8 Drawing Sheets

MOLTEN METAL SUPPLY DEVICE

BACKGROUND OF THE INVENTION

The present invention relates to a molten metal supply device, and more particularly, to the molten metal supply device for supplying molten metal to a die-casting machine.

Japanese Patent Application Kokai No. SHO-63-119965 discloses an open-type molten metal temperature maintaining furnace for smoothly and economically supplying molten metal to the die-casting machine. The disclosed open-type molten metal temperature maintaining furnace uses an electromagnetic pump to supply molten metal to the die-casting machine. By immersing an immersion body in the molten metal, a suction head can be supported at a fixed level so that the injection amount of the electromagnetic pump can be maintained at a fixed level.

In concrete terms, as shown in FIG. 6, a partition wall 113 having a communication gate 113*a* divides a holding furnace 102 into a holding chamber 105 and a supply chamber 117. A molten metal level detector 112 is provided to the supply chamber 117. An immersion body 106 capable of being raised and lowered is provided in the holding chamber 105. An electromagnetic pump 182 is connected between the supply chamber 117 and an injection sleeve 171 through a duct 123. A control portion 180 is provided for controlling raising and lowering operations of the immersion body 106 so that the molten metal level detector 112 always detects a uniform liquid surface level. Maintaining the liquid surface at a fixed level keeps a suction head at a fixed level so that the amount suctioned by the electromagnetic pump 182 is also maintained at a fixed level. This allows a fixed amount of molten metal to be supplied to the injection sleeve 171.

The open-type molten metal temperature maintenance furnace described in the JP publication provides an inexpensive temperature maintenance furnace with a simple configuration. However, the electromagnetic pump 182 has a complicated configuration including electronic circuits and ceramic components. The ceramic components are connected at many positions, which increases the potential for molten metal leaks. Further, should the cooling fan of the electromagnetic pump 182 stop because of a power failure or other reason, the coil is likely to be damaged by excessive heat. As a countermeasure for power failure, an auxiliary power source must be provided. As a result, a great many maintenance operations are required, which increases running costs.

Japanese Patent Application Kokai No. HEI-3-238155 describes a method of supplying molten metal to the die casting machine. The method is used in a molten metal supplying device provided with a supply chamber and a holding chamber. The supply chamber is pressurized by compressed air. This supplies a fixed amount of molten metal to an injection sleeve.

More specifically, as shown in FIG. 7, a holding furnace 202 is divided into a holding chamber 205 and a supply chamber 217. The supply chamber 217 is connected to an injection sleeve 233 of a die-casting machine through a duct 223. A stopper 214 capable of moving between a fluid communication position and a blocking position is provided for selectively switching the holding furnace 205 and the supply chamber 217 into and out of fluid communication with each other. A molten metal level detector 212 is provided in the holding furnace 202. Compressed air can be supplied to the holding chamber 205 and the supply chamber 217. To supply molten metal to the injection sleeve 271, compressed air is supplied to the holding chamber 205 until the molten metal level detector 212 detects the molten metal surface at a predetermined level, which indicates that the surface level in the holding furnace 202 and in the supply chamber 217 is at a predetermined level. Afterward, the stopper 214 is moved to the blocking position, thereby sealing the supply chamber 217. A predetermined amount of molten metal is supplied to the injection sleeve 271 by supplying compressed air to the supply chamber 217.

The molten metal supply method described in the JP publication No. HEI-3-238155 provides a molten metal supply device having a simple configuration. However, fluctuation in expansion of air and inertia of air pressure make controlling air pressure difficult so that fluctuations are generated in the supplying amount. Accordingly, this device is not applicable to die-casting machine which requires a high degree of precision in injection amounts. Also, air can get mixed in with the molten metal when controlling the supplying amount using compressed air. This can promote oxidation of the molten metal, thereby reducing product quality.

Further, the JP publication SHO-63-119965 and JP publication No. HEI-3-238155 do not take into consideration the durability and thermal maintenance properties of the supply conduit, that is, the duct 123 ('965 publication) and the duct 223 ('155 publication). Accordingly, the durability and thermal maintenance properties of the duct and associated mouthpiece are insufficient. This can cause damage or molten metal leaks as a result of thermal expansion. This can also lead to reductions in temperature, which make producing products with uniform quality difficult. Further, vibration of the main body of the die-casting machine can be transmitted directly to the molten metal device, most likely causing damage there.

Japanese Utility Model Publication No. HEI-5-34840 discloses a mouthpiece and Japanese Utility Model Publication No. HEI-5-43980 discloses a duct. The mouthpiece and the duct are used in a molten metal supply tube fluidly connecting between a molten metal holding furnace and the injection sleeve of the die-casting machine.

Briefly, the JP publication HEI-5-34840 has a mouthpiece 324 as shown in FIG. 8. The mouthpiece 324 includes a ceramic inner layer 336 and an insulation case 338 covering the inner layer 336. The inner layer 336 is connected to the injection sleeve 371 of the pie-casting machine. An injection plunger 333 is reciprocally movably provided to the die-casting machine. The mouthpiece 324 is connected to a duct 323, which is connected to a molten metal holding furnace. The mouthpiece 324 is attached to the injection sleeve 371 by a thermal insulation plate 339, a pressing plate 341, and a bolt 343. A protective pipe portion 340 for heating the molten metal within the mouthpiece 324 is provided following the axial center of the mouthpiece 324. A heating member 337 is removably inserted in the center of the protective pipe portion 340.

Although the mouthpiece 324 of the supply conduit described in JP publication No. HEI-5-34840 can be expected to improve temperature maintenance of the molten metal, it is insufficiently durable. Also, thermal deformation of the mouthpiece 324 can cause leaks of molten metal to easily occur at a connecting portion between the injection sleeve 371 and the mouthpiece 324.

The JP publication No. HEI-5-43980 describes the duct 433 as shown in FIG. 9. The duct 433 is formed from a layered ceramic spacer layer 417 provided around the periphery of a ceramic tube 445 that is resistant to molten metal. To form the ceramic spacer layer 417, ceramic fibers having a porous sheet shape are immersed in an adhesive that is resistant to molten metal. The sheet is wrapped around the ceramic tube 445, dried, and fired.

Further, although the duct of the supply conduit described in the JP publication No. HEI-5-43980 can be expected to improve durability of the duct, it has inferior temperature maintaining properties. Also, during actual use, thermal expansion can be generated in the axial direction of the duct, which may damage the duct. In addition, generally, ceramic members have poor resistance to vibration and shock and so have insufficient mechanical strength. However, molten metal holding furnaces and die-casting machine are connected only by the supply conduit such as the duct. Therefore, the duct is directly subjected to vibration from the die-casting machine, thereby possibly damaging the duct.

SUMMARY OF THE INVENTION

It is therefore, an object of the present invention to provide a molten metal supply device capable of supplying molten metal with high precision and applicable to a die-casting device with low running costs.

Another object of the invention is to provide such a molten metal supply device that has a supply conduit having sufficient temperature maintenance capability, that is less influenced by thermal expansion of the supply conduit caused by the molten metal, and that is capable of reducing potential of molten metal leaks and damage to the conduit.

These and other objects of the present invention will be attained by providing a molten metal supply device for supplying a molten metal to an injection sleeve of a die-casting machine, the molten metal supplying device including a holding furnace for holding the molten metal, a partition wall, blocking means, surface level detection means, first and second immersion bodies, and first and second driving means. The partition wall is provided in the holding furnace so as to divide the holding furnace into a holding chamber and a supply chamber and to provide fluid communication between the holding chamber and the supply chamber. The blocking means is movable between a fluid communication position and a blocking position for selectively blocking fluid communication between the holding chamber and the supply chamber. The surface level detection means is adapted for detecting a predetermined surface level of the molten metal in the holding furnace. The first immersion body is vertically movably provided in the holding chamber. The first drive means is adapted for moving the first immersion body downwardly to introduce the molten metal from the holding chamber to the supply chamber until the predetermined liquid surface level is detected by the detection means when the blocking means is in the communication position. The second immersion body is vertically movably provided in the supply chamber. The second drive means is adapted for moving the second immersion body downwardly to supply the molten metal from the holding chamber to the injection sleeve when the blocking means is in the blocking position.

In another aspect of the present invention, there is provided a molten metal supply device for supplying a molten metal to an injection sleeve of a die-casting machine, the device including a holding furnace, and an improved supply conduit means provided between the holding furnace and the injection sleeve for supplying molten metal from within the holding furnace to the injection sleeve. The supply conduit means has a duct connected to the holding furnace and a mouthpiece connecting the duct to the injection sleeve. The duct includes a ceramic sleeve serving as an inner layer, the ceramic sleeve having an outer peripheral surface, a iron-based metal tube covering the outer peripheral surface, the iron-based metal tube having an outer periphery, a space being provided between the ceramic sleeve and the iron-based metal tube, a heat line wrapped around the outer periphery of the iron-based metal tube, a heat resistant mortar covering the heat line, and an iron-based metal particle layer filling the space.

DETAILED DESCRIPTION OF THE PREFERRED EMBODIMENTS

A molten metal supply device according to one embodiment of the present invention will be described with reference to FIGS. 1 through 5(*d*).

Figure 1:
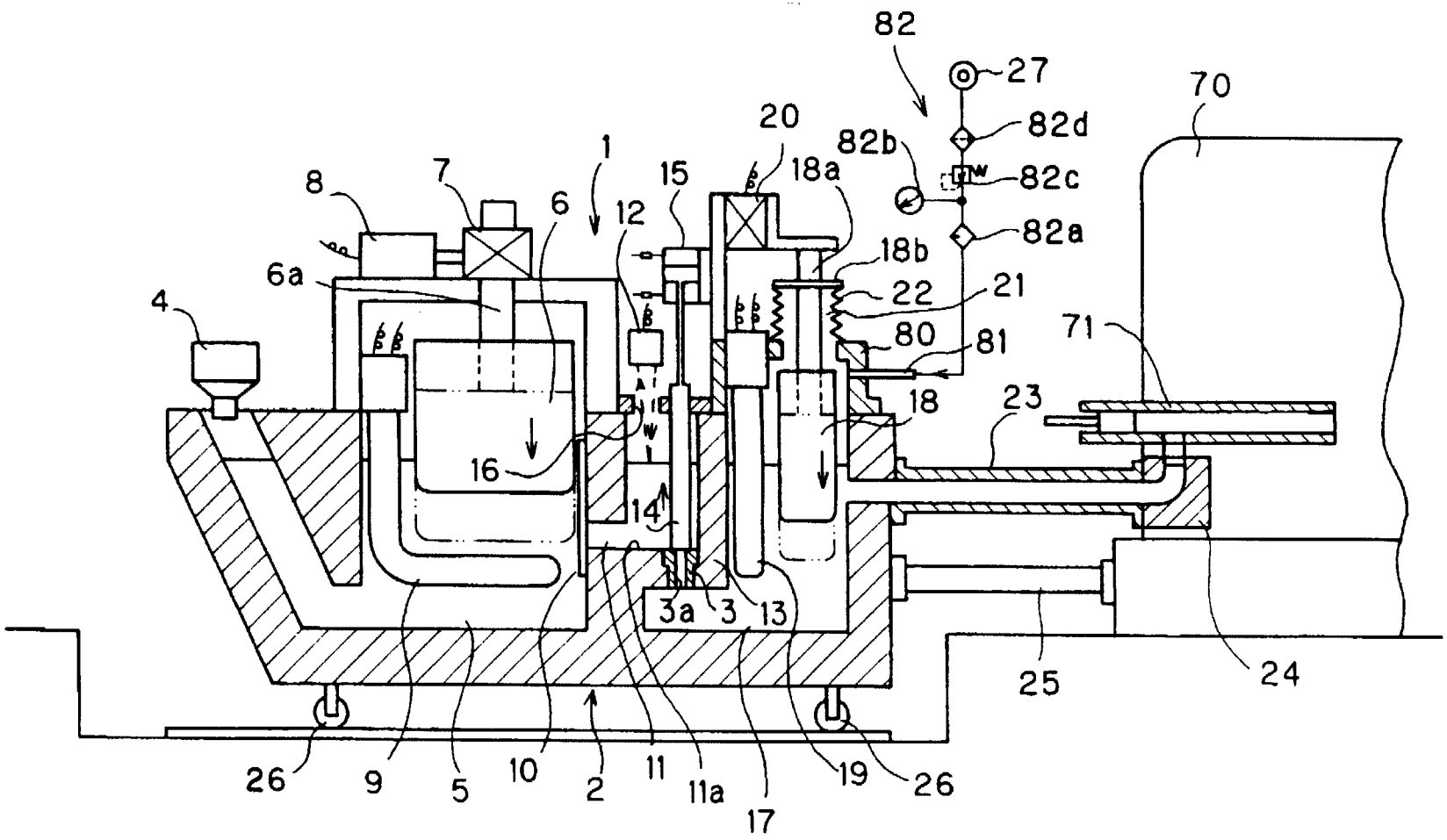
FIG. 1 is a vertical cross-sectional view showing essential components of a molten metal supply device according to an embodiment of the present invention.

FIG. 1 shows the overall configuration of a molten metal supply device 1. A holding furnace 2 is separated by a partition wall 13 into a holding chamber 5 and a supply chamber 17. The holding chamber 5 is provided with a reception gate 4 for introducing the molten metal to the holding chamber 5. A liquid level detection chamber 11 adjacent to the partition wall 13 is provided in the holding chamber 5. A ceramic filter 10 for removing impurities is provided near the entrance of the liquid level detection chamber 11. An open area 16 is formed above the liquid level detection chamber 11. A laser sensor 12 is installed above the open area 16. The laser sensor 12 is a type that detects the molten metal when the surface of the molten metal exceeds a predetermined level.

A through hole opened by counterboring is formed in the floor of the partition wall 13. A bushing 3 is fitted in the through hole. The bushing 3 forms a through hole 3*a*, which fluidly connects the holding chamber 5 and the supply chamber 17.

A stopper 14 for bringing the holding chamber 5 and the supply chamber 17 into and out of fluid connection is provided vertically movable above the bushing 3. The stopper 14 is connected to a cylinder 15 so as to follow the drive of the cylinder 15. The stopper 14 lowers when the cylinder 15 extends out, thereby abutting the bushing 3 and cutting off the holding chamber 5 from the supply chamber 17. The stopper 14 rises when the cylinder 15 pulls in, thereby opening the through hole 3a of the bushing 3 and bringing the holding chamber 5 and the supply chamber 17 into fluid connection.

A first immersion body 6 is vertically movably provided to the holding chamber 5. A support shaft 6a is provided to the first immersion body 6. A rack (not shown in the drawings) is formed to the support shaft 6a. The rack of the support shaft 6a is engaged with a gear of a gear box 7 provided above the first immersion body 6. The gear box 7 is connected to a cyclo-reduction motor 8. Accordingly, the first immersion body 6 rises and lowers following drive of the cyclo-reduction motor 8. When the stopper 14 is in a raised condition so that the holding chamber 5 and the supply chamber 17 are in fluid communication, the first immersion body 6 is lowered so that the molten metal from within the holding chamber 5 is introduced into the supply chamber 17 until the laser sensor 12 detects a predetermined surface level of the molten metal. A holding chamber heater 9 for heating the molten metal within the holding chamber 5 is installed to the holding chamber 5. The holding chamber heater 9 maintains the viscosity and other properties of the molten metal to desired level.

A second immersion body 18 is provided vertically movable in the supply chamber 17. The second immersion body 18 is provided with a support shaft 18a. The tip of the support shaft 18a is attached to a uniaxial robot 20. The second immersion body 18 rises and lowers following operation of the uniaxial robot 20. With this configuration, after the cylinder 15 extends out so that the stopper 14 blocks fluid communication between the holding chamber 5 and the supply chamber 17, then, when the second immersion body lowers, molten metal is supplied to an injection sleeve 71 of the die-casting machine 70 via a supply conduit, such as a duct 23 to be described later.

A flange 18b is provided to the support shaft 18a and one end of a bellows 22 is attached to the flange 18b. A clasp attaches the other end of the bellows 22 to the wall defining the supply chamber 17. Accordingly, the bellows 22 moves in association with the second immersion body 18 and serves to separate the supply chamber 17 from the atmosphere. A pipe 81 is connected to the clasp 80. An inert gas supply source 27 is connected to the pipe 81 by a set 82 consisting of an oiler 82a, regulator 82b and 82c, and a filter 82d. The bellows 22 is filled with inert gas. The pipe 81, the set 82, and the supply source 27 comprise an inert gas introduction means for equalizing pressure of the inert gas with atmospheric pressure. That is, with this configuration, when the stopper 14 rises so that the holding chamber 5 and the supply chamber 17 are brought into communication, the inert gas introduction means maintains pressure of the inert gas within the bellows 22 at atmospheric pressure, thereby preventing oxidation of the molten metal so that high-quality products can be produced. When the stopper 14 lowers so that communication between the holding chamber 5 and the supply chamber 17 is obstructed, supply of inert gas into the bellows 22 is stopped and the bellows 22 is sealed shut. When molten metal is supplied to the injection sleeve 71, the second immersion body 18 and the bellows 22 move in association so that pressure of inert gas increases within the bellows, thereby accelerating speed at which molten metal is supplied. In contrast to this, when the second immersion body 18 rises to stop supply of the molten metal to the injection sleeve 71, then a negative pressure builds within the bellows, thereby accelerating the molten metal shut-off speed at which the supply of molten metal is removed from the injection sleeve 71.

A supply chamber heater 19 for heating the molten metal within the supply chamber 17 is installed in the supply chamber 17. In the same manner as the holding chamber heater 9, the supply chamber heater 19 maintains temperature of the molten metal and maintains properties of the molten metal such as viscosity.

Figure 2:
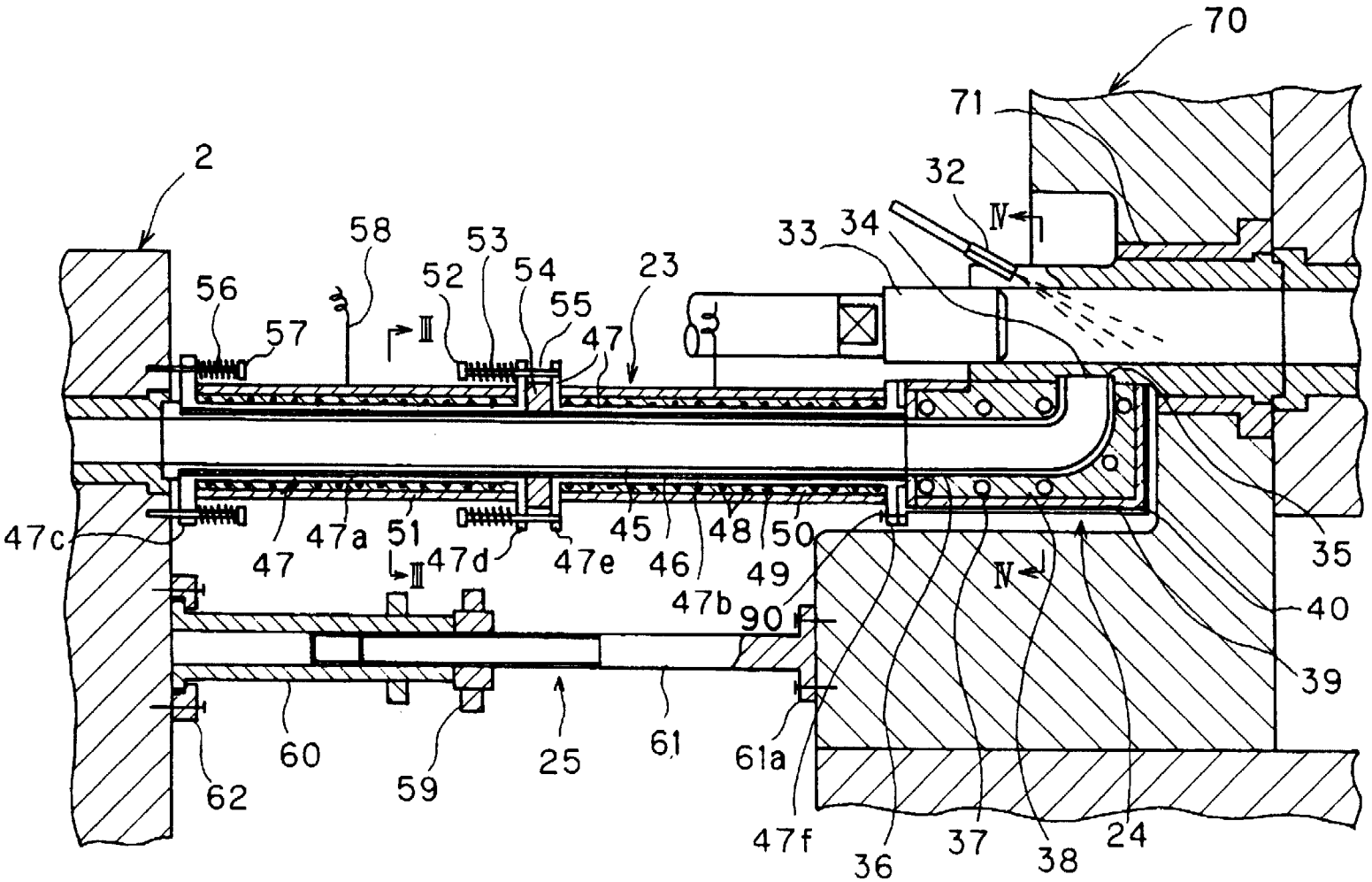
FIG. 2 is a vertical cross-sectional view showing a duct and a mouthpiece of the molten metal supply device according to the embodiment of the present invention.
Figure 3:
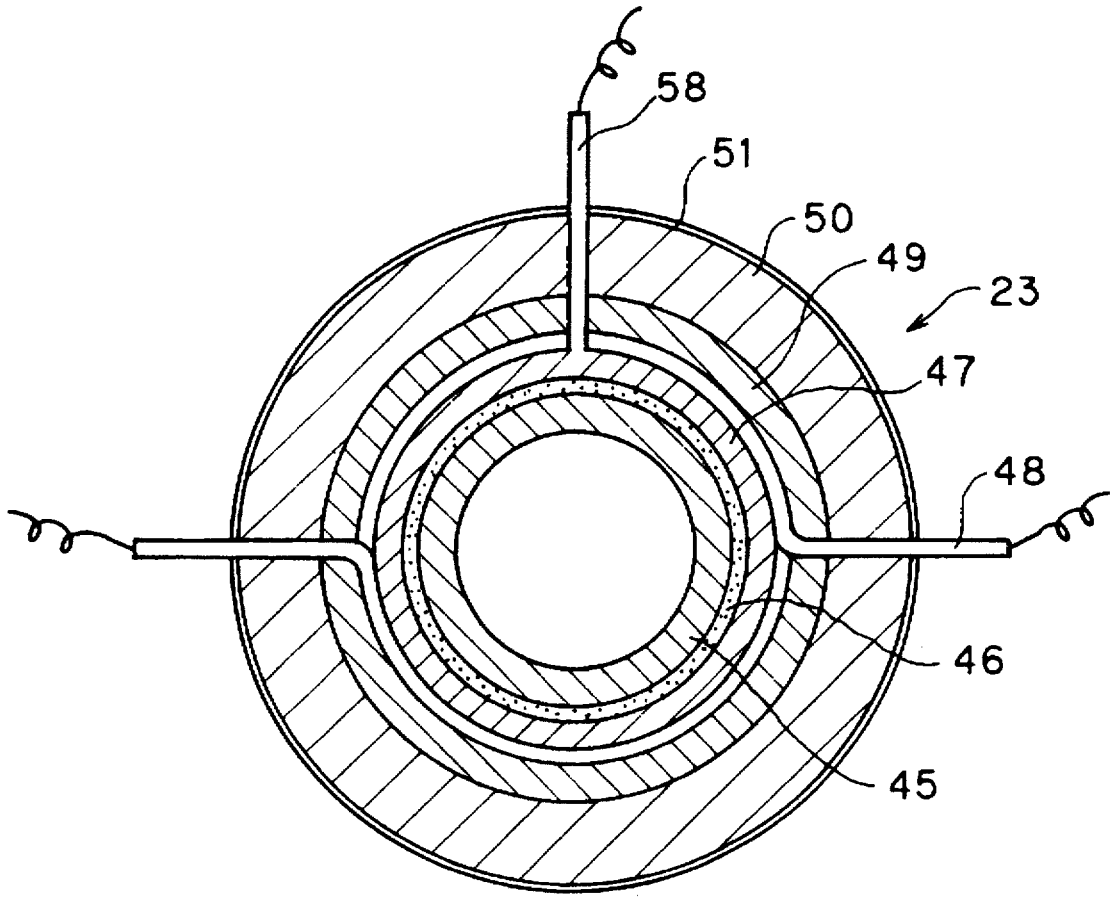
FIG. 3 is a cross-sectional view taken along line III—III of FIG. 2.
Figure 4:
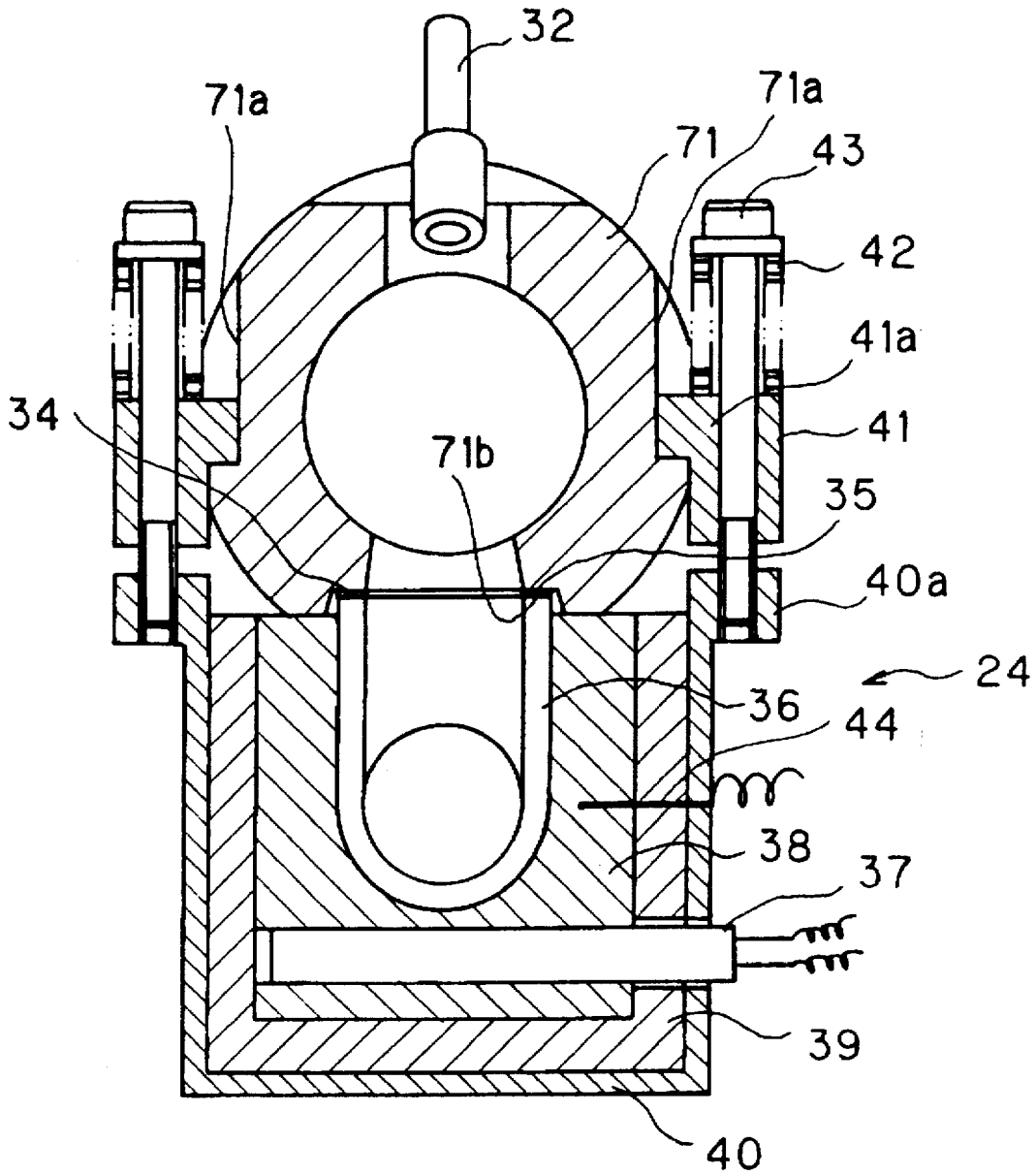
FIG. 4 is a cross-sectional view taken along line IV—IV of FIG. 2.

Next, an explanation of the supply conduit for connecting the holding furnace 2 and the injection sleeve 71 and for supplying molten metal will be provided while referring to FIGS. 2 through 4. The supply conduit includes the duct 23 connected to the holding furnace 2 and a mouthpiece 24 connected to the duct 23.

The duct 23 connected to the holding furnace 2 is provided with a ceramic sleeve 45 that comes into direction contact with the molten metal. As such, it will be assumed that the ceramic sleeve 45 is made from a heat resistant material such as $Si_3N_4$ or SiC. The ceramic sleeve 45 is covered with a stainless steel tube 47. The space between the ceramic sleeve 45 and the stainless steel tube 47 is filled with stainless steel particles 46 to increase heat transmission efficiency. A micro heater 48 for heating the molten metal flowing within the ceramic sleeve 45 is wound around the outside of the stainless steel tube 47. The outer side of the micro heater 48 is covered with fire-resistant mortar 49. The fire-resistant mortar 49 is adapted for protecting the micro heater 48 and for improving heat efficiency. The fire-resistant mortar 49 is covered with an insulating material 50. The insulating material 50 is covered with a stainless steel case 51. A thermocouple 58 for controlling temperature of the micro heater 48 is attached to the stainless steel tube 47.

The above-described stainless steel tube 47 is formed from a holding furnace 2 side stainless steel tube 47a and a mouthpiece 24 side stainless steel tube 47b having their ends aligned together. The holding furnace 2 side stainless steel tube 47a includes flanges 47c and 47d at either end. The mouthpiece 24 side stainless steel tube 47b includes flanges 47e and 47f at either end. The flanges 47d of the stainless steel tube 47a is in confronting relation with the flange 47e of the stainless steel tube 47b with a space between the flanges 47d and 47e.

That is, the flange 47d of the stainless steel tube 47a is urged by a spring 53 and a bolt 52 toward the flange 47e of the stainless steel tube 47b and into attachment with the flange 47e. In concrete terms, the bolt 52 is fitted freely in the flange 47d and screwed to the flange 47e. The spring 53 is mounted between the head of the bolt 52 and the flange 47d. A cylindrical expansion absorption member 54 made from ceramic fiber is provided between the flanges 47d and 47e. The flanges 47d and 47e, the bolts 52, the springs 53, and the thermal expansion member 54 comprises a thermal expansion absorption structure 55 for absorbing thermal expansion of the stainless steel sleeves in their axial direction.

The flange 47c of the stainless steel tube 47a is urged toward the holding furnace 2 by a duct attachment bolt 57 and a spring 56 into attachment with the holding furnace 2. In concrete terms, the duct attachment bolt 57 is freely fitted in the flange 47c and screwed into the holding furnace 2. The spring 56 is mounted between the head of the duct attachment bolt 57 and the flange 47c. Also, the flange 47f of the stainless steel tube 47b is attached to the mouthpiece 24 by a bolt 90.

Next, an explanation of the configuration of the mouthpiece 24 will be provided.

The mouthpiece 24 includes a bent tube connecting the duct 23 with the injection sleeve 71. The inner layer of the mouthpiece 24 includes a ceramic tube 36 made from $Si_3N_4$, SiC, and the like with which the molten metal is in contact during transportation. The ceramic tube 36 has one open end connected to the duct 23 and another end serving as an injection gate 34 in communication with the injection sleeve 71. The ceramic tube 36 is covered with a fire resistant mortar layer 38. Rod-shaped cartridge heaters 37 are embedded within the fire resistant mortar layer 38 so as to follow the curve of the ceramic tube 36. The outer periphery of the fire resistant mortar layer 38 is covered with an insulating material 39. Further, the outer periphery of the insulating material 39 is covered with a stainless steel case 40. A thermocouple 44 for controlling temperature of the cartridge heaters 37 is embedded in the fire resistant mortar layer 38. An open edge 40*a* (see FIG. 4) is formed in the stainless steel case 40.

As shown in FIG. 4, a mouthpiece support body 41 is engaged to the injection sleeve 71. The mouthpiece 24 is suspended by the mouthpiece support body 41. More specifically, protruding pawls 41*a* for engaging the injection sleeve 71 are provided to the mouthpiece support body 41. The mouthpiece support body 41 is engagingly supported in notches 71*a* of the injection sleeve 71. A bolt 43 is freely fitted to the mouthpiece support body 41. A compression spring 42 is mounted between the head of the bolt 43 and the mouthpiece support body 41. The bolt 43 is screwed into the open edge 40*a* of the stainless steel case 40. The mouthpiece 24 is suspended on the injection sleeve 71 by the mouthpiece support body 41. For this reason, the injection gate 34 of the ceramic tube 36 of the mouthpiece 24 is urged toward a pouring port 71*b* of the injection sleeve 71. Packing 35 for preventing leaks of molten metal is mounted between the injection gate 34 of the ceramic tube 36 and the pouring port 71*b* of the injection sleeve 71.

Next, a connection member 25 will be described with reference to FIGS. 1 and 2. The connection member 25 is adapted for connecting the holding furnace 2 with a main body of the die-casting machine 70. As described above, the holding furnace 2 and the injection sleeve 71 of the die-casting machine 70 are connected by the duct 23 and the mouthpiece 24. The connection member 25 is disposed between the holding furnace 2 and the main body of the die-casting machine 70 to strengthen the connection between the holding furnace 2 and the die-casting machine 70. A carriage 26 is provided to the above-described holding furnace 2 so that the holding furnace 2 is movable in the axial direction of the duct 23. A plunger tip 33 is provided reciprocally movable to the injection sleeve 71. Also, a well-known lubrication oil nozzle 32 is provided facing the inner peripheral surface of the injection sleeve 71.

The connection member 25 includes a connection shaft 61, lock nut 59 screwed on the connection shaft 61, and a connection shaft receptor 60 fixed to the holding furnace 2. That is, a flange 61*a* is provided to the base end of the connection shaft 61. The flange 61*a* is fixed via a bolt to the main body of the die-casting machine 70. The free end portion of the connection shaft 61 is formed with a male screw and the inner periphery of the connection shaft receptor 60 is formed with a female screw threadingly engageable with the male screw. The base end of the connection shaft receptor 60 is rotatably attached to the holding furnace 2 by a clasp 62. The lock nut 59 is rotatably screwed onto the male screw of the connection shaft 61.

Next, operation of the molten metal supply device 1 will be described. After a predetermined amount of molten metal is supplied into the reception gate 4, the cyclo-reduction motor 8 is driven to lower the first immersion body 6 until the laser sensor 12 detects the surface level of the molten metal. When the first immersion body 6 lowers, the surface level of the supply chamber 17 rises to a predetermined position.

After the liquid surface level rises to the predetermined level, the cylinder 15 extends so that the stopper 14 abuts against the bushing 3. This closes the through hole 3*a* so that fluid communication between the thermal holding chamber 5 and the supply chamber 17 is blocked. At this time, as shown in FIG. 5(*a*), the liquid surface level of the molten metal is maintained in the mouthpiece 24 immediately below the injection gate 34 of the injection sleeve 71.

After the stopper 14 blocks fluid communication between the holding chamber 5 and the supply chamber 17, the uniaxial robot 20 is driven to lower the second immersion body 18. The liquid surface level of the molten metal within the mouthpiece 24 and the holding chamber 5 rises an amount equivalent to the immersion volume of the second immersion body 18. As a result, a predetermined amount of molten metal overflows from the mouthpiece 24 so that, as shown in FIG. 5(*b*), molten metal is supplied into the injection sleeve 71. At this point, the bellows 22 contracts in association with the lowering of the second immersion body 18, thereby compressing the inert gas filling the bellows 22. The increased pressure accelerates supply of molten metal to the injection sleeve 71.

After molten metal is supplied into the injection sleeve 71, the plunger tip 33 is operated to introduce the molten metal into a mold cavity (not shown in the drawings). As shown in FIG. 5(*c*), when the plunger tip 33 plugs the injection gate 34, the liquid surface level of the molten metal in the injection sleeve 71 rises further. On the other hand, in synchronization with the timing at which the plunger tip 33 plugs the injection gate 34, the uniaxial robot 20 is driven to start raising the second immersion body 18. In association with rise of the second immersion body 18, the molten metal in the mouthpiece 24 and the duct 23 backflows so that molten metal is removed from the injection sleeve 71. At this time a negative pressure develops in the bellows 22 in association with the rising of the second immersion body 18, thereby accelerating removal of the molten metal.

Figure 5:
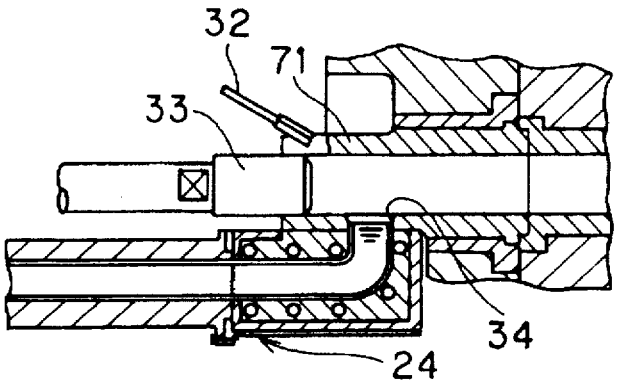
FIGS. 5(*a*) 5(*b*), 5(*c*) and FIG. 5(*d*) show schematic views showing each sequential step in supply of molten metal to an injection sleeve of a die-casting machine.
Figure 5:
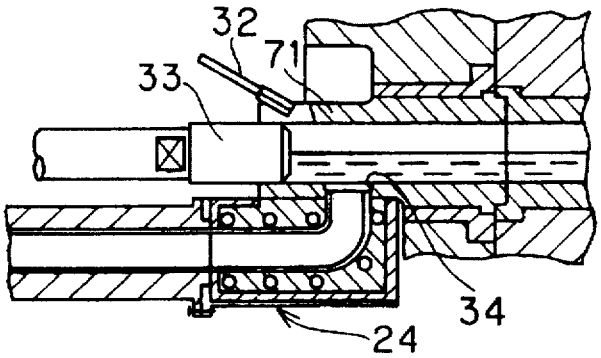
Figure 5:
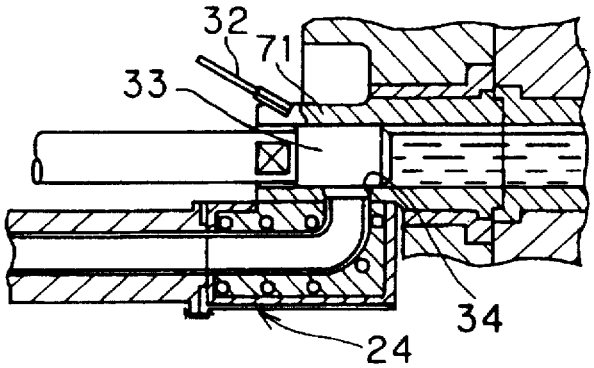
Figure 5:
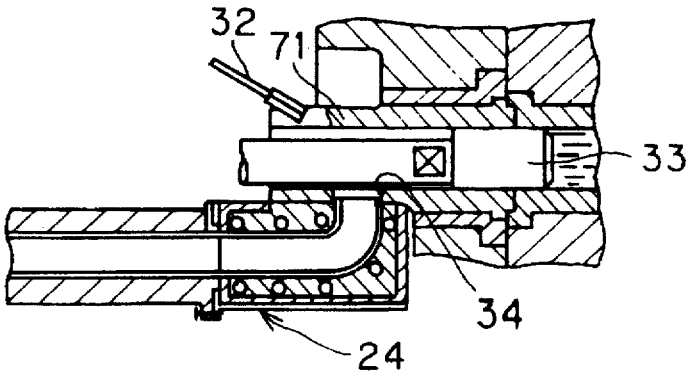
Figure 6:
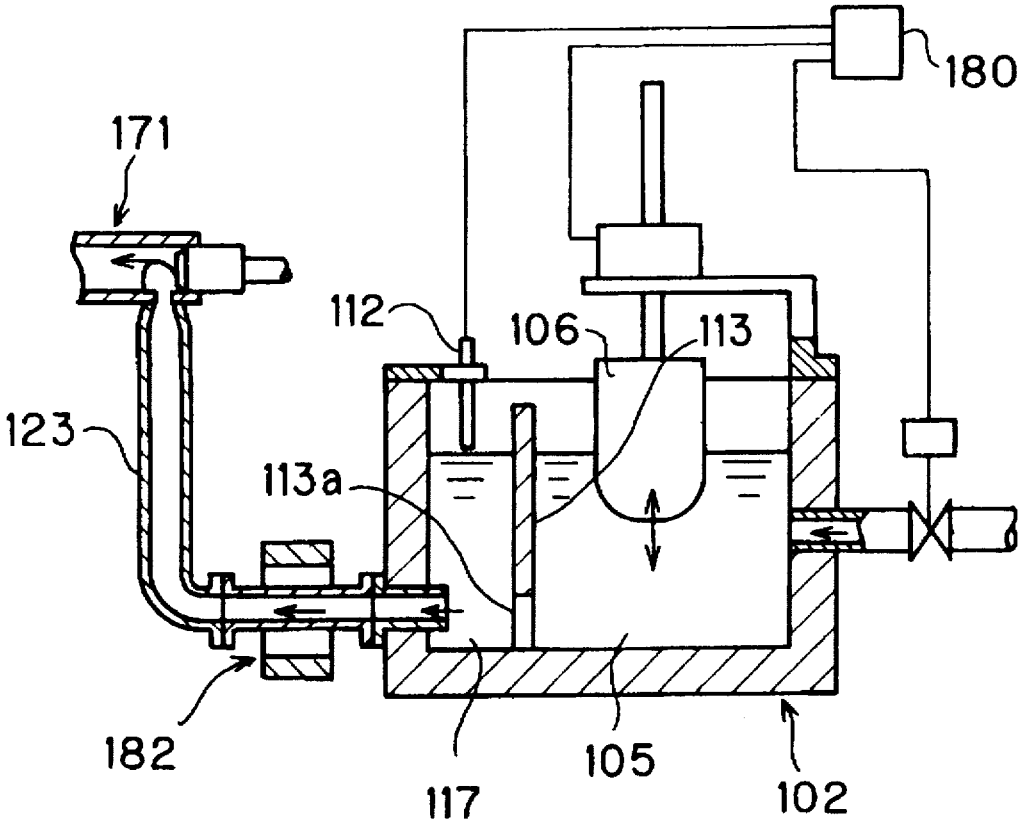
FIG. 6 PRIOR ART
FIG. 6 is a vertical cross-sectional view showing a conventional open-type molten metal supply device.
Figure 7:
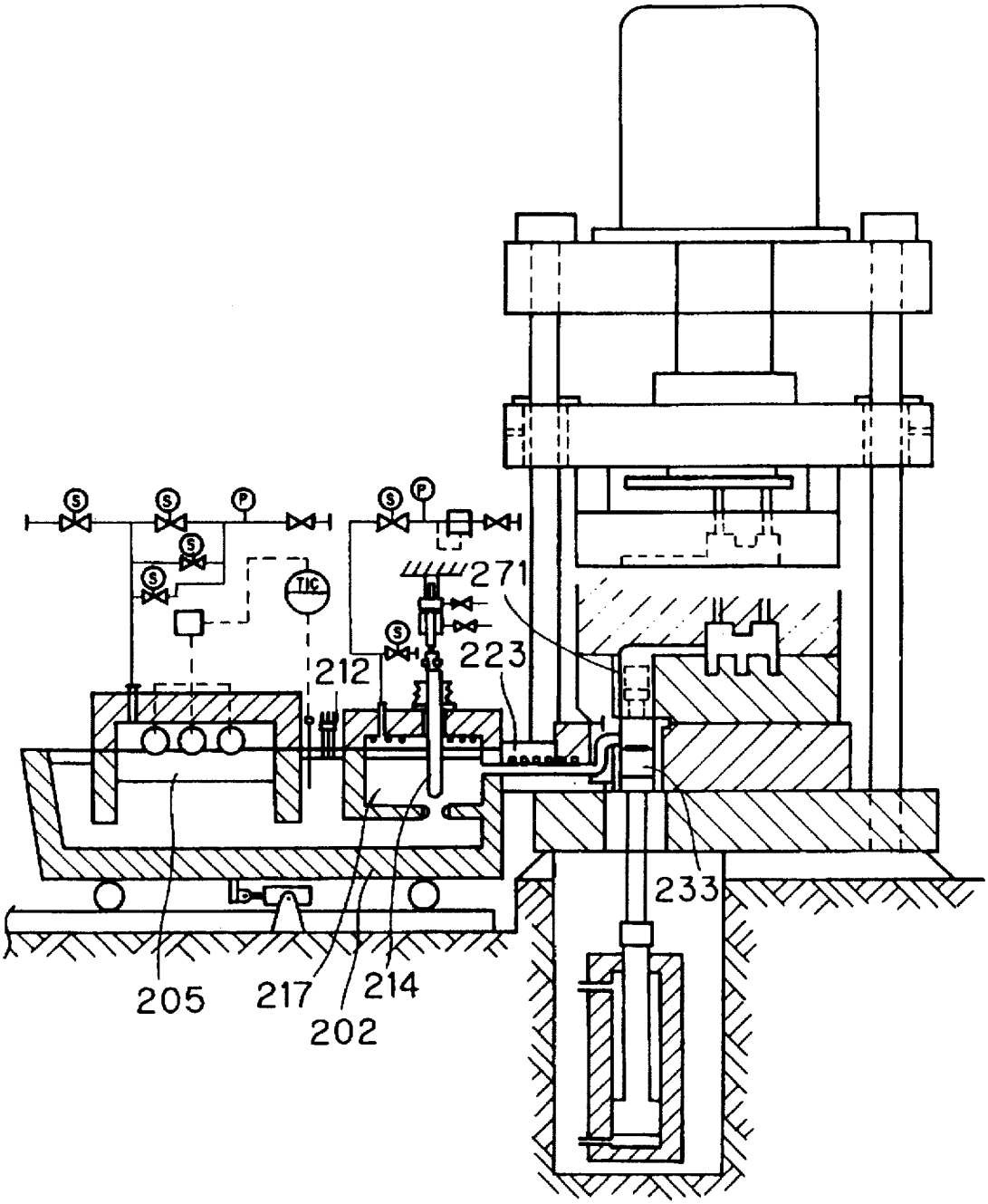
FIG. 7 PRIOR ART
FIG. 7 is a vertical cross-sectional view showing a conventional pressure-type molten metal supply device.
Figure 8:
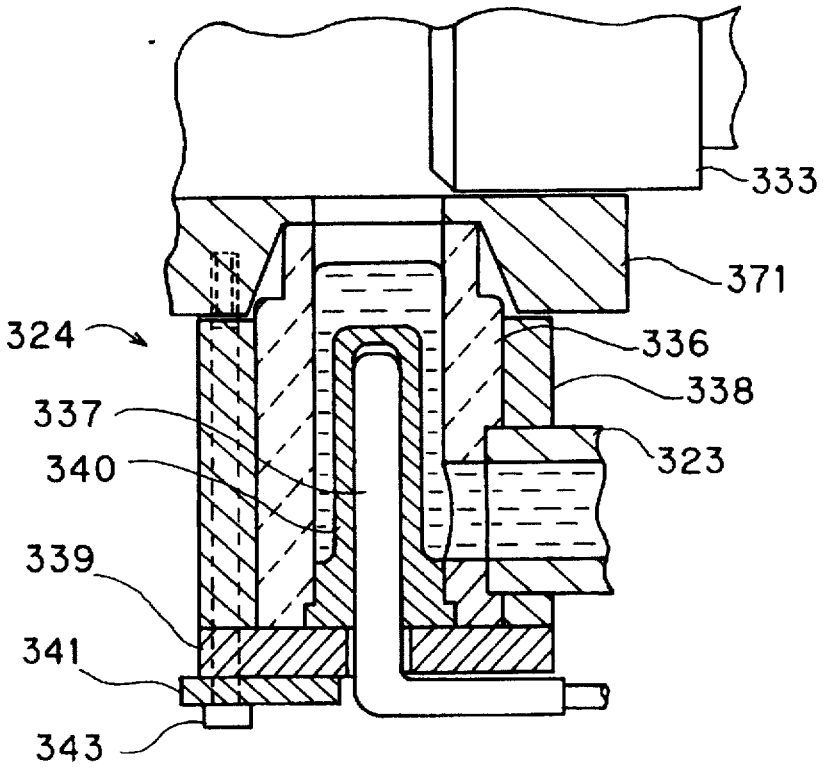
FIG. 8 PRIOR ART
FIG. 8 is a cross-sectional view showing a conventional mouthpiece used in a conventional molten metal supply device.
Figure 9:
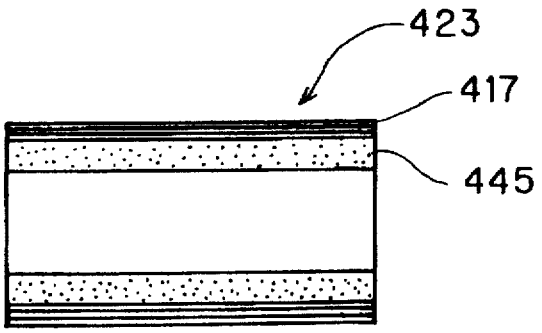
FIG. 9 PRIOR ART
FIG. 9 is a cross-sectional view showing a conventional duct used in a conventional molten metal supply device.

The plunger tip 33 proceeds further forward until it reaches a predetermined position as shown in FIG. 5(*d*), whereupon the molten metal filling process into the mold cavity is completed. After the molten metal in the cavity is solidified, preparations are made for the next casting at the die-casting machine 70. That is, the product is removed from the cavity, the metal die is cleaned, and lubricating oil is sprayed from the lubrication oil nozzle 32.

After the second immersion body 18 is raised to its upper limit, the cylinder 15 is driven to raise the stopper 14 so that the holding chamber 5 and the supply chamber 17 are brought into fluid communication with each other. By bringing the holding chamber 5 and the supply chamber 17 into fluid communication, the liquid surface level becomes equal throughout the chambers 5, 17. At this time, the liquid surface level will be lower compared with before supplying molten metal to the injection sleeve 71.

To bring the liquid level surface back to the level of before supplying molten metal to the injection sleeve 71, the first immersion body 6 is lowered until the laser sensor 12 detects the liquid surface level. By repeating the above-described operations, a set amount of molten metal is supplied to the injection sleeve 71. Once the first immersion body 6 reaches its lowermost position, the first immersion body 6 is raised, and molten metal is supplemented into the holding chamber 5 from the reception gate 4.

Throughout the process, the surface of the molten metal is not aggressively pressurized. Therefore, molten metal can be supplied using a simple structure and in quantities with little variation in the molten metal amount. Also, maintenance is simple and running costs are low because no electromagnetic pump is required. Also, because the surface of the molten metal is not aggressively pressurized, even when molten metal accidentally leaks from the duct or the mouthpiece while the molten metal is moving from the supply chamber to the injection sleeve, only an amount of molten metal equal to the volume of the immersed portion of the second immersion body will leak. In other words, leaks will not develop due to pressurization. Further, by introducing inert gas into the supply chamber, oxidation of the molten metal can be reduced. Also, because the bellows are compressed during supply of molten metal, speed at which molten metal is supplied can be accelerated. Further, because the bellows are raised during removal of molten metal, a negative pressure develops in the molten metal supply chamber. This improves precision and speed of shut-off of the molten metal.

Turning to the duct 23, the molten metal comes in contact with a ceramics tube 45 having heat resistant properties. An iron-based metal tube 47 covers the outer periphery of the ceramic tube 45 so that mechanical strength is insured. Further, temperature maintaining properties are insured by a heat line 48 wrapped around the outer periphery of the iron-based metal tube and by heat resistant mortar 49 covering the heat line. Heat of the iron-based metal tube 47 is reliably transmitted to the ceramic tube 45 by a layer of iron-based metal particles 46 filling the gap between the ceramic sleeve 45 and the iron-based metal tube 47. Therefore, molten metal having a desired quality can be supplied to the injection sleeve 71.

To supply molten metal from the holding furnace 2 to the injection sleeve 71, the molten metal passes through the duct 23 and the mouthpiece 24. For this reason, the temperature of the duct 23 and the mouthpiece 24 rises so that the duct 23 and the mouthpiece 24 deform due to thermal expansion. Thermal expansion rate of the stainless steel used in the duct 23 is much greater than the thermal expansion rate of the ceramics. Therefore, the stainless steel tube 47 elongates to a greater extent than does the ceramic sleeve 45. For this reason, two or more stainless steel tubes **47*a*, 47*b* covering the ceramic tube 45 of the duct 23 are aligned end to end, and the stainless steel tubes 47*a*, 47*b* are separated in an axial direction. Thus, differences between the ceramic tube 45 and the stainless steel tube 47*a*, 47*b* in elongation caused by thermal expansion accompanying supply of molten metal can be absorbed and molten metal leaks can be prevented. Further, the thermal expansion absorbing member 54 can be compressed so that the distance separating the stainless steel tube 47*a* and the stainless steel tube 47*b*** narrows, thereby absorbing the difference in thermal expansion between the ceramic tube and the stainless steel tube.

Turning to the mouthpiece 24, because the cartridge heaters 37 are embedded in the mortar layer 38 covering the ceramic tube 36, the molten metal can be efficiently transported within the mouthpiece 24 and temperature can be properly maintained.

Also, the connection portion of the pouring port **71*b* of the injection sleeve 71 and the injection gate 34 of the ceramic tube 36 expand in the vertical cross-sectional direction shown in FIG. 4. However, damage to the mouthpiece 24 and molten metal leaks can be prevented by the compression spring 42, which serves as an urging means, absorbing the expansion. Therefore, even if this type of expansion is generated, molten metal will not leak from the connection portion and damage to the mouthpiece 24** can be prevented.

Turning to the connection member 25, if the thermal expansion absorbing member 54 can not sufficiently absorb expansion of the duct 23 and the mouthpiece 24, it becomes necessary to slightly increase the distance between the holding furnace 2 and the main body of the die-casting machine 70 by an amount proportional to the thermal expansion. Unless the connection member 25 is readjusted frequently, stress concentration may occur in the duct 23 and possibly damage the duct 23. To this end, the connection distance between the holding furnace 2 and the main body of the die-casting machine 70 is adjusted to match elongation of the duct 23 that has expanded by the molten metal. To be more specific, after loosening the lock nut 59, an operator turns the connection shaft receptor 60 to adjust the overall length of the connection member 25. After adjusting the connection member 25, the lock nut 59 is tightened to prevent vibration and the like from rotating the connection shaft receptor 60 and bringing it out of adjustment. By connecting the holding furnace 2 to the main body of the die-casting machine 70 using the connection member 25 including the length adjusting mechanism, stress load on the duct 23 from thermal expansion and from vibration of the die-casting machine can be reduced, and damage to the duct 23 can be prevented. Also, molten metal leaks caused by deformation of the holding furnace 2 can be prevented. In summary, the length adjustment mechanism allows the die-casting machine 70 and the holding furnace 2 to be strongly fixed together, and yet prevents the supply conduit 23 from being damaged even when the supply conduit 23 thermally expands.

While the invention has been described in detail and with reference to the specific embodiment thereof, it would be apparent to those skilled in the art that various changes and modifications may be made therein without departing from the spirit and scope of the invention.

What is claimed is:

1. A molten metal supply device for supplying a molten metal to an injection sleeve of a die-casting machine, the molten metal supplying device including:

a holding furnace for holding the molten metal;

a partition wall provided in the holding furnace so as to divide the holding furnace into a holding chamber and a supply chamber and to provide fluid communication between the holding chamber and the supply chamber;

and the improvement comprising:

blocking means movable between a fluid communication position and a blocking position for selectively blocking fluid communication between the holding chamber and the supply chamber;

supply conduit means provided between the supply chamber and the injection sleeve for supplying the molten metal from the supply chamber to the injection sleeve, the supply conduit means having a duct connected to the holding furnace and a mouthpiece connecting the duct to the injection sleeve;

an injection port through which the molten metal is introduced into the injection sleeve;

surface level detection means for detecting a surface level of the molten metal within the mouthpiece at a position immediately below the injection port in the holding furnace; a first immersion body vertically movably provided in the holding chamber;

first drive means for moving the first immersion body downwardly to introduce the molten metal from the holding chamber to the supply chamber until the liquid surface level is detected by the detection means when the blocking means is in the communication position; a second immersion body vertically movably provided in the supply chamber; and second drive means for moving the second immersion body downwardly to supply the molten metal from the holding chamber to the injection sleeve when the blocking means is in the blocking position.

2. The molten metal supply device as claimed in claim 1, wherein the supply chamber has an upper open end portion, and the molten metal supply device further comprising:

a bellows provided at the open end portion of the supply chamber for separating molten metal in the supply chamber from atmosphere, the bellows being movable in association with the second immersion body; and inert gas introduction means fluidly connected with the bellows for introducing an inert gas into the bellows, the inert gas introduction means maintaining atmospheric pressure on a surface of the molten metal in the supply chamber only when the blocking means is in the communication position.

3. The molten metal supply device as claimed in claim 1, wherein the duct comprises:

a ceramic sleeve serving as an inner layer, the ceramic sleeve having an outer peripheral surface;

a iron-based metal tube covering the outer peripheral surface, the iron-based metal tube having an outer periphery, a space being provided between the ceramic sleeve and the iron-based metal tube;

a heat line wrapped around the outer periphery of the iron-based metal tube;

a heat resistant mortar covering the heat line; and an iron-based metal particle layer filling the space.

4. The molten metal supply device as claimed in claim 3, wherein the iron-base metal tube is formed from at least two stainless steel tubes aligned end to end in an axial direction thereof, the stainless steel tubes being spaced away from each other at confronting portions thereof.

5. The molten metal supplying device as claimed in claim 4, further comprising a thermal expansion absorbing means provided at the confrontation portions for urging the confronting portions toward each other.

6. The molten metal supply device as claimed in claim 1, wherein the mouthpiece comprises:

a ceramic tube as an inner layer and having an open end;

a fire resistant mortar layer covering the ceramic tube; and cartridge heaters embedded in the fire resistant mortar layer.

7. The molten metal supply device as claimed in claim 6 wherein the injection sleeve has an injection gate connected to the open end of the ceramic tube;

and wherein the mouthpiece further comprises:

a case member as an outermost layer for supporting the ceramic tube;

a support body supportedly engaged with the injection sleeve, the mouthpiece support body suspendingly supporting the case member; and urging means connected between the support body and the case member for maintaining urging of the open end of the ceramic tube toward the injection gate.

8. The molten metal supply device as claimed in claim 1, wherein the holding furnace is provided movable in an axial direction of the duct;

and the molten metal supply device further comprises connection means connecting the holding furnace to the die-casting machine, the connection means having a length adjusting mechanism for adjusting a connecting length between the holding furnace and the die-casting machine.

9. A molten metal supply device for supplying a molten metal to an injection sleeve of a die-casting machine, the device including:

a holding furnace; and a supply conduit means provided between the holding furnace and the injection sleeve for supplying molten metal from within the holding furnace to the injection sleeve, the supply conduit means having a duct connected to the holding furnace and a mouthpiece connecting the duct to the injection sleeve;

and the improvement comprising the duct comprising:

a ceramic sleeve serving as an inner layer, the ceramic sleeve having an outer peripheral surface;

a iron-based metal tube covering the outer peripheral surface, the iron-based metal tube having an outer periphery, a space being provided between the ceramic sleeve and the iron-based metal tube;

a heat line wrapped around the outer periphery of the iron-based metal tube;

a heat resistant mortar covering the heat line; and an iron-based metal particle layer filling the space.

10. The molten metal supply device as claimed in claim 9, wherein the iron-base metal tube is formed from at least two stainless steel tubes aligned end to end in an axial direction thereof, the stainless steel tubes being spaced away from each other at confronting portions thereof.

11. The molten metal supplying device as claimed in claim 10, further comprising a thermal expansion absorbing means provided at the confrontation portions for urging the confronting portions toward each other.

12. The molten metal supply device as claimed in claim 9, wherein the mouthpiece comprises:

a ceramic tube as an inner layer and having an open end;

a fire resistant mortar layer covering the ceramic tube; and cartridge heaters embedded in the fire resistant mortar layer.

13. The molten metal supply device as claimed in claim 12 wherein the injection sleeve has an injection gate connected to the open end of the ceramic tube;

and wherein the mouthpiece further comprises:

a case member as an outermost layer for supporting the ceramic tube;

a support body supportedly engaged with the injection sleeve, the mouthpiece support body suspendingly supporting the case member; and urging means connected between the support body and the case member for maintaining urging of the open end of the ceramic tube toward the injection gate.

14. The molten metal supply device as claimed in claim 9, wherein the holding furnace is provided movable in an axial direction of the duct;

and the molten metal supply device further comprises connection means connecting the holding furnace to the die-casting machine, the connection means having a length adjusting mechanism for adjusting a connecting length between the holding furnace and the die-casting machine.

* * * * *